US005841231A

United States Patent [19]

Kimura et al.

[11] Patent Number: 5,841,231

[45] Date of Patent: Nov. 24, 1998

[54] PHOTOMULTIPLIER HAVING LAMINATION STRUCTURE OF FINE MESH DYNODES

[75] Inventors: Suenori Kimura; Masuo Ito; Atsuhide Suzuki, all of Hamamatsu, Japan

[73] Assignee: Hamamatsu Photonics K.K., Hamamatsu, Japan

[21] Appl. No.: 649,305

[22] Filed: May 17, 1996

[30] Foreign Application Priority Data

May 19, 1995 [JP] Japan ..... 7-121492

[51] Int. Cl.[6] ..... H01J 43/04

[52] U.S. Cl. ..... 313/532; 313/533

[58] Field of Search ..... 313/528, 530, 313/532, 533, 534, 535, 536, 537, 541, 542, 103 R, 103 CM, 105 CM, 422, 583, 584, 585, 586

[56] References Cited

U.S. PATENT DOCUMENTS

| | | | |
|---|---|---|---|
| 3,114,044 | 12/1963 | Sternglass | 250/207 |
| 4,871,943 | 10/1989 | Eschard | 313/532 |
| 5,572,089 | 11/1996 | Kyushima | 313/532 |

FOREIGN PATENT DOCUMENTS

| | | |
|---|---|---|
| 40-21012 | 9/1940 | Japan . |
| 51-43068 | 4/1976 | Japan . |
| 59-221960 | 12/1984 | Japan . |

OTHER PUBLICATIONS

Janoth et al, "Response of Mesh–Type Photomultiplier Tubes in Strong Magnetic Fields", Nuclear Instruments and Methods in Physics Research A 350 (1994) pp. 221–225.

Hearty, "Detection of Small Light Pulses and Pulse Height Resolution of a Fine Mesh Photomultiplier Tube", Nuclear Instruments of Methods in Physics Research A 365 (1995), pp. 83–87ˆFujii et al, Tests of Photon–Detection Devices in Strong Magnetic Fileds, Nuclear Instruments and methods in Physics Research A 366 (1995), pp. 71–75.

Barbiellini et al, "A Simulation Study of the Behaviour of Fine Mesh Photomultipliers in Magnetic Field", Nuclear Instruments of Methods in Physics Research A362 (1995), pp. 245–252.

*Primary Examiner*—Ashok Patel
*Assistant Examiner*—Vip Patel
*Attorney, Agent, or Firm*—Cushman Darby & Cushman IP Group of Pillsbury Madison & Sutro LLP

[57] ABSTRACT

The present invention concerns a photomultiplier having a lamination structure of fine mesh dynodes arranged at predetermined intervals, capable of detecting photons even in a high magnetic field. This photomultiplier is arranged so that hollow pipes penetrating electrodes for supporting the fine mesh dynodes define the lamination structure of an electron multiplier unit. This arrangement permits the intervals between the fine mesh dynodes to be accurately controlled, thereby obtaining the photomultiplier production errors of which are well suppressed and preventing that the fine mesh dynodes are ripped.

21 Claims, 17 Drawing Sheets

MAXIMUM RADIUS OF GYRATION OF ELECTRON $R = \frac{m\nu}{eB} \cdot \sin\theta$ (m)

MAXIMUM PERIOD OF GYRATION OF ELECTRON $T = \frac{2\pi m}{eB}$ (s)

VELOCITY OF ELECTRON IN MOTION $\nu = \sqrt{\frac{2e\nu_\phi}{m}}$ (m/s)

MASS OF AN ELECTRON $m = 9.1095 \times 10^{-31}$ (kg)

CHARGE OF AN ELECTRON $e = 1.6022 \times 10^{-19}$ (C)

PHOTOMULTIPLIER HAVING LAMINATION STRUCTURE OF FINE MESH DYNODES

BACKGROUND OF THE INVENTION

1. Field of the Invention

The present invention relates to a photomultiplier capable of detecting photons even in a high magnetic field. More particularly, the invention relates to an assembly structure for laminating dynode units each having their fine mesh dynodes, and to a voltage supply structure for setting a photocathode at a predetermined potential.

2. Related Background Art

Specific examples of the conventional photomultipliers capable of detecting photons in a high magnetic field are those described in Japanese Laid-open Patent Applications No. 51-43068 and No. 59-221960. These publications disclose the structure having an electron multiplier unit in which a plurality of mesh dynodes are layered with intervention of insulator.

SUMMARY OF THE INVENTION

The present invention is directed to a photomultiplier provided with an electron multiplier unit with a plurality of fine mesh dynodes being layered at predetermined intervals, capable of detecting photons even in a high magnetic field. An object of the present invention is to provide an assembly structure which permits accurate control of intervals between adjacent fine mesh dynodes by layering dynode units having respective fine mesh dynodes without deformation or destruction during assembly of the electron multiplier unit, and to provide a voltage supply structure for setting a photocathode at a predetermined potential.

A feature of the photomultiplier according to the present invention is that it can operate even in a magnetic field, as described above. For this, the photomultiplier uses the fine mesh dynodes of a small line width and has such structure that the spacing intervals of the fine mesh dynodes are narrow, whereby electron orbits of secondary electrons emitted from the fine mesh dynodes are less affected by the external magnetic field. In particular, the interval between the photocathode and the first-stage fine mesh dynode is limited to the range of 2.0 mm to 5.0 mm and the intervals between the adjacent fine mesh dynodes are limited to the range of 0.4 mm to 1.6 mm. Here, we use the "fine mesh dynode" to mean one having at least 1000 lines per inch, and recent mainstream fine mesh dynodes commercially available are those having 1500–2000 lines per inch. In this specification, these fine mesh dynodes having 1500 lines and 2000 lines are denoted by #1500 and #2000.

The photomultiplier according to the present invention is a photomultiplier capable of detecting photons even in a high magnetic field, as described above. It comprises, for example as shown in FIGS. 1, 2, 8, and 11, at least a photocathode 11 for emitting photoelectrons according to light incident thereto; an electron multiplier unit 100 for cascade-multiplying the photoelectrons emitted from the photocathode 11; and an anode 6, disposed at a position a predetermined distance apart from the electron multiplier unit 100 through an insulator 42, for collecting secondary electrons emitted from the electron multiplier unit 100. These photocathode 11, electron multiplier unit 100, and anode 6 are housed in a closed container consisting of a housing 1 with an aluminum film 1*a* formed on an internal wall thereof, and a stem 8 for supporting conductive lead pins 9 for setting dynode units 500 at respective, predetermined potentials.

The electron multiplier unit is constructed in a lamination structure in which the plural dynode units 500 are arranged at predetermined intervals through insulators 41 (first insulators) each having through holes extending along a direction L of incidence of light. Each dynode unit 500 comprises a fine mesh dynode 50 described above, an upper electrode 51 having an aperture portion 51*c* for exposing a first surface 50*a* of the fine mesh dynode 50 and through holes 51*a* extending along the direction L of incidence of light, and a lower electrode 52 having an aperture portion 52*c* for exposing a second surface 50*b* of the fine mesh dynode 50 opposite to the first surface 50*a*, and through holes 52*a* extending along the direction L of incidence of light and holding an edge portion of the fine mesh dynode 50 in a sandwich structure in cooperation with the upper electrode 51 (see FIG. 22). The upper electrode 51 has a projecting portion 51*b* for electrically connecting the dynode unit 500 through a relay lead pin 7 with an associated one of the lead pins 9 supported in the stem 8.

In the photomultiplier, the insulators 41, 42 have the through holes extending along the direction L of incidence of light, and similarly, the anode 6 also has through holes extending along the direction L of incidence of light. The insulators 41, 42, dynode units 500, and anode 6 are layered so that the through holes thereof are aligned with each other along the direction L of incidence of light.

Further, the photomultiplier comprises pipes 2 each penetrating corresponding spaces defined by the through holes in the laminated members along the direction L of incidence of light. Specifically, each pipe 2 includes, as shown in FIG. 6, an outside pipe 201 made of an insulating material (alumina, or the like) and an inside pipe 200 made of a conductive material (stainless steel, or the like) and penetrating the outside pipe 201. The inside pipe 200 has an edge portion 202 having a larger diameter than a diameter of an aperture of the outside pipe 200, at a first end thereof.

For example, when a fine mesh dynode 50 of #1500 or #2000 is produced, the fine mesh dynode 50 could be deflected, and it is difficult to construct the lamination structure only of such fine mesh dynodes. An embodiment according to the present invention is arranged to prevent the deflection of the fine mesh dynodes 50 by clamping the edge portion of each fine mesh dynode between the upper electrode 51 and the lower electrode 52 as exerting predetermined tension thereon, as described above. However, as seen from FIG. 1 and FIG. 22, the upper and lower electrodes 51, 52 are disks having their respective apertures 51*c*, 52*c*. From this structural feature, the dynode units 500 obtained have sufficient strength against force applied in directions of the circumference of the upper and lower electrodes 51, 52 while they are readily deformed by force applied in a direction of lamination of the dynode units 500 (coincident with the direction L of incidence of light) (or against force applied from the first surface side and/or from the second surface side of fine mesh dynode 50). For example, supposing such force (the force exerted in the lamination direction) is exerted on the dynode units 500, it becomes difficult to accurately control the intervals between the adjacent fine mesh dynodes 50. Furthermore, since the predetermined tension is applied to the fine mesh dynodes 50 by the upper and lower electrodes 51, 52, the deformation of the dynode units 500 cause the destruction of the fine mesh dynodes themselves.

In the photomultiplier according to the present invention, a caulking 205 is formed at a predetermined position of each pipe 2 (inside pipe 200) explained above, after the pipe penetrates the through holes in the members described above. By this, the edge portions 202 and caulkings 205 of the inside pipes 200 define the lamination structure of the electron multiplier unit 100. The caulking 205 is formed in the inside pipe 200 by applying force in the direction perpendicular to the lamination direction of the dynode units 500. The inside pipe 200 is hollow. Thus, only weak force needs to be applied onto the inside pipe 200, thereby realizing the assembly structure free from the force enough to deform the dynode units 500 in the assembly process of the electron multiplier unit 100.

Further, the photomultiplier according to the present invention comprises, as shown in FIG. 10, a conductive ring 3 having an aperture 304, disposed between the photocathode 11 and the electron multiplier unit 100, for letting the photoelectrons emitted from the photocathode 11 pass. This conductive ring 3 has through holes 302 extending along the direction L of incidence of light, and a contact electrode 301 for setting the conductive ring 3 and photocathode 11 at a same potential. When the inside pipes 200 are set through the through hole 302, the edge portions thereof 202 are in direct contact with the conductive ring 3. This is for setting the photocathode 11 at the predetermined potential by electrically connecting the end of an inside pipe 200 through a relay lead pin 7 with an associated lead pin 9. Therefore, the inside pipes 200 function to define the lamination structure of the electron multiplier unit 10 and also function as lead pins for supply of a voltage for setting the photocathode 11 at the predetermined potential.

The conductive ring 3 further has spring electrodes 300 for setting the electron multiplier unit 100 at a predetermined position in the closed container so that the electron multiplier unit 100 may be located a predetermined distance apart from the internal wall of the closed container. Inside the closed container the electron multiplier unit 100 is positioned by the spring electrodes 300 of the conductive ring 3 in the horizontal direction with respect to the direction L of incidence of light and by the relay lead pins 7 in the vertical direction accordingly.

While separated a predetermined distance from the electron multiplier unit 100 by insulators 40 (second insulators or upper insulators), the conductive ring 3 is fixed to the electron multiplier unit 100 by the pipes 2 set through the through holes 30 of the conductive ring 3. The insulators 40 have respective through holes extending along the direction L of incidence of light, and the pipes 2 are set through the through holes. While separated a predetermined distance apart from the electron multiplier unit 100 through insulators 42, the anode 6 is also fixed to the electron multiplier unit 100 by the pipes 2. The insulators 42 also have respective through holes extending along the direction of incidence of light, and the pipes 2 are set through the through holes.

The photomultiplier further has insulators 43 (third insulators or lower insulators), in contact with a surface of the anode 6 opposite to the surface thereof opposed to the electron multiplier unit 100, for separating the anode 6 a predetermined distance from the second ends of the pipes 2 (inside pipes 200) located on the opposite side to the first ends thereof (the ends provided with the edge portions 202). Each insulator 43 has an upper part 430 and a lower part 431 each having a through hole extending along the direction of incidence of light.

The outside pipes 201 each have at least a length enough for the entire outside pipe 201 to be housed in a space defined by the through hole 302 of conductive ring 3, the through holes of insulators 40, 41, 42, 43, the through holes of dynode units 500, and the through hole of anode 6. The inside pipes 200 each have at least a length enough to penetrate the space defined by the through hole of conductive ring 3, the through holes of insulators 40, 41, 42, 43, the through holes of dynode units 500, and the through hole of anode 6 and enough to expose the both ends of inside pipe from the space. In other words, the length of the inside pipe 200 is longer than that of the outside pipe 201. The through hole of the upper part 430 of each insulator 43 has a larger diameter than the outside pipe 200, and the through hole of the lower part 431 of each insulator 43 has a smaller diameter than the outside pipe 201 and has a larger diameter than the inside pipe 200. For this structure, the outside pipe 201 can be accommodated in the space. Furthermore, the outside pipe 201 functions so as to electrically isolate the inside pipe 200 from the dynode units 500, and the inside pipe 200 can function as a part of an inner wire of the closed container.

Next, the inventors examined a space rate or porosity of the fine mesh dynodes adapted to the photomultiplier in order to achieve optimum control of multiplication factor (a number of secondary electrons reaching the anode/a number of photoelectrons occurring on a photoelectric surface) of the photomultiplier according to the present invention. As a result, the inventors found out that the optimum porosity was between 45% and 65% for the line width in the range of 2.4 $\mu$m to 6 $\mu$m.

The reason why the line width is set to be not more than 6 $\mu$m is that it is necessary to avoid a decrease of the multiplication factor of the photomultiplier due to behavior (the maximum radius of gyration) of electrons in a magnetic field. The reason why the line width is set to be not less than 2.4 $\mu$m is that the fine mesh dynodes 50 themselves need to have strength enough to stand the tension exerted thereon when produced.

From the viewpoint of production, the preferred porosity of the fine mesh dynodes is between 45% and 50%. For example, if the line width is less than 2.4 $\mu$m, a risk of breakage of the fine mesh dynodes 50 increases during production thereof. In this specification, the porosity S (%) of the fine mesh dynodes 50 is defined by the following equation where a is the line width and b is the line pitch (see FIG. 12 and FIG. 13).

$$S(\%)=[(b-a)^2/b^2]\times 100$$

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

The embodiments of the photomultiplier tube according to the present invention will be explained with reference to FIG. 1 to FIG. 29.

Figure 1:
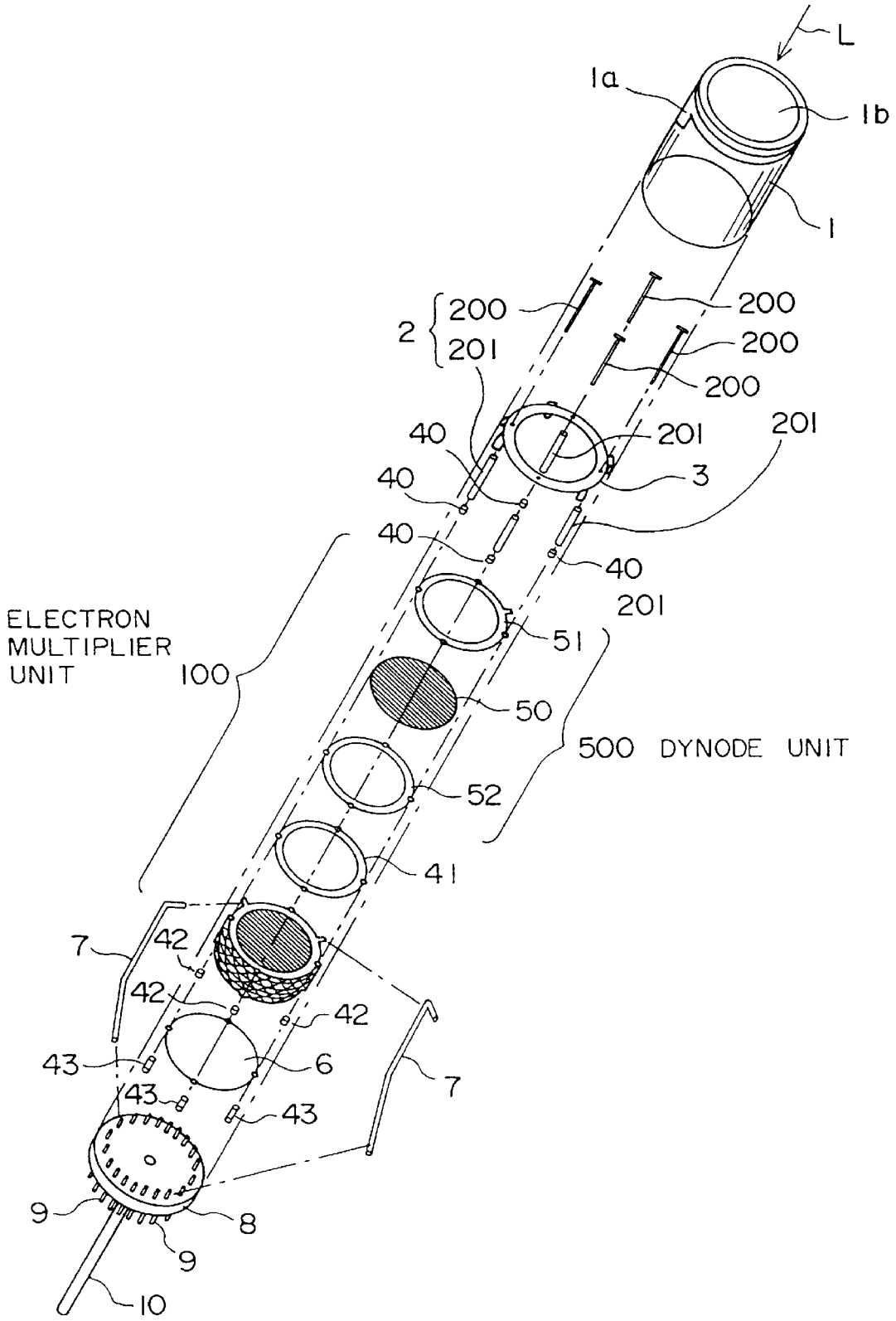
FIG. 1 is a drawing to show the assembly process of the whole of the photomultiplier according to the present invention.

FIG. 1 is a drawing to show the assembly process of the whole of the photomultiplier according to the present invention. In this figure, the photomultiplier has a closed container consisting of a cylindrical housing 1 on an internal wall of which an aluminum film 1*a* becoming an electrode for supply of a voltage to the photocathode is formed, and a stem 8 supporting lead pins 9 for supplying voltages supplied from the external bleeder circuit (see FIG. 9) to the desired dynodes etc., in a state where the lead pins 9 penetrate the stem 8. The bottom of the stem 8 is provided with a pipe 10 for introducing a metal vapor for forming the photocathode after assembly.

A conductive ring 3 functioning as a focusing electrode is fixed through insulators 40 each having their through holes to the side of the first-stage dynode unit of an electron multiplier unit 100 housed in the above closed container and an anode 6 is also fixed through insulators 42 each having their through holes to the side of the final-stage dynode unit of the electron multiplier unit 100. This electron multiplier unit 100 is set at a predetermined position in the closed container with respect to the direction L of incidence of light while being supported by relay lead pins 7 for supplying the predetermined voltages. The conductive ring 3 and anode 6 both have their through holes extending along the direction L of incidence of light.

Further, the electron multiplier unit 100 is composed of a plurality of dynode units 500 as successively layered through ring insulators 41. In this specification, for example, supposing sixteen dynode units 500 are laminated, the first-stage dynode unit to the final-stage (sixteenth-stage) dynode unit are denoted by DY1, DY2, . . . , DY15, DY16 in order (see FIG. 9).

Specifically, a dynode unit 500 described above is composed of a fine mesh dynode 50, for example, of #1500 and the line width in the range of 5.5 $\mu$m to 5.6 $\mu$m, and ring upper electrode 51 and lower electrode 52 for clamping the edge portion of the fine mesh dynode 50 as applying the predetermined tension to the fine mesh dynode 50. Each ring electrode 51, 52 has an aperture for letting photoelectrons from the photocathode or secondary electrons from the previous fine mesh dynodes 50 pass and through holes extending along the direction L of incidence of light.

These conductive ring 3, insulators 40, 41, 42, dynode units 500, and anode 6 are incorporated by pipes 2 while their through holes are aligned with each other in the lamination direction of the fine mesh dynodes 50 (which is the same direction as the direction L of incidence of light), thereby constituting the lamination structure of the electron multiplier unit 100. In this arrangement insulators 43 through which the pipes 2 pass are provided on the stem side of the anode 6, thus preventing contact between the anode 6 and the pipes 2.

Figure 2:
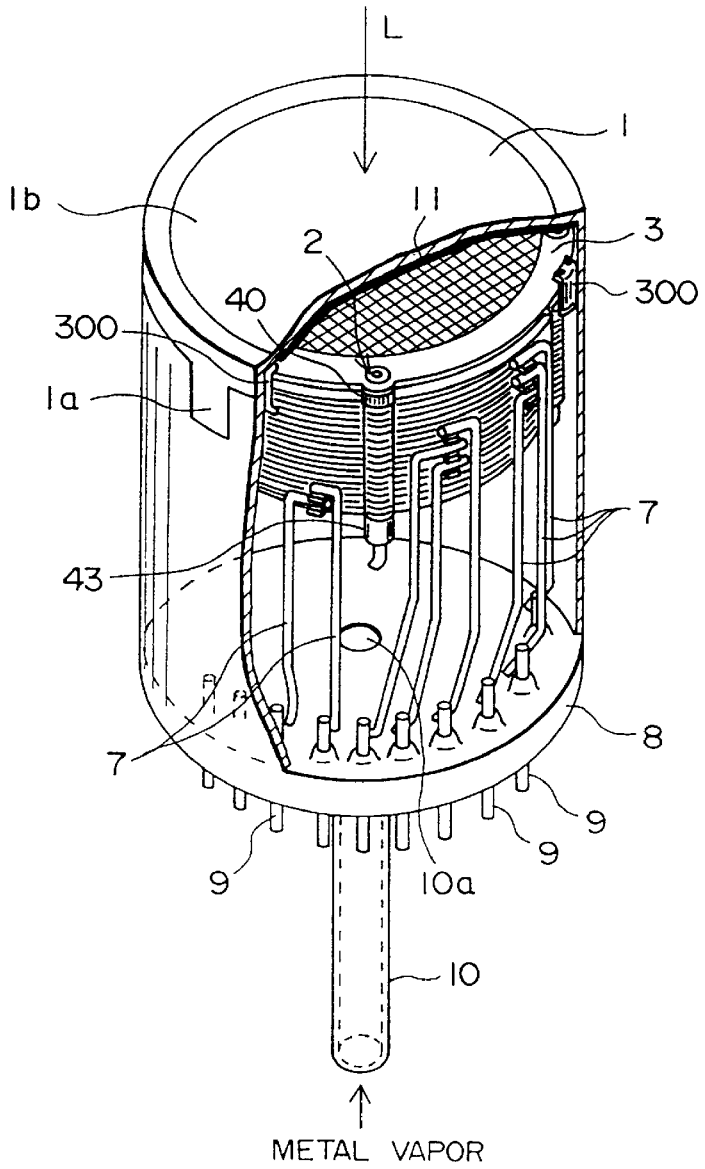
FIG. 2 is a perspective view of the photomultiplier shown in FIG. 1, showing the structure after assembled.

The major part of the photomultiplier shown in FIG. 2 is obtained by the above assembly process.

Figure 3:
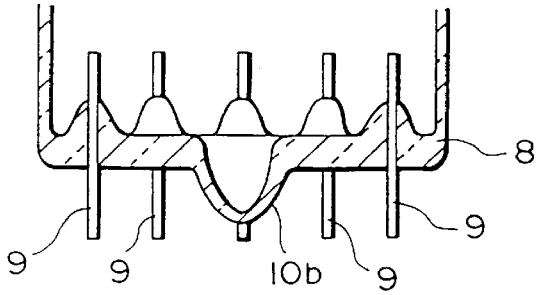
FIG. 3 is a cross-sectional view of the stem portion in the photomultiplier shown in FIG. 2, showing the structure of the stem portion after the photocathode is formed.

Subsequently, while the closed container comprised of the housing 1 and stem 8 is set a vacuum state therein, the metal vapor for forming the photocathode is introduced through the pipe 10 into the closed container to form the photocathode 11 on the internal wall corresponding to the light incidence portion 1*b* of the housing 1. At this time, the closed container is heated without the light incidence portion 1*b* because of generating a temperature difference between the light incidence portion 1*b* and the other portion of the closed container, thereby the metal can be deposited on the inner wall of the light incidence portion 1*b*. After that, a through hole 10*a* of the pipe 10 is heated to close the aperture and to maintain a vacuum state inside the closed container, as shown in FIG. 3. In the figure, 10*b* represents a part of the pipe 10 hermetically closed by heating. The metals for forming the photocathode can be selectively deposited on a predetermined portion of the inside wall of the closed container by heating the predetermined portion.

Next explained referring to FIG. 4 to FIG. 8 is the structure of pipe 2 for realizing the assembly structure of the electron multiplier unit 100 and the lamination structure of the dynode units 500.

In the electron multiplier unit 100 the dynode units 500 are layered through the ring insulators 41. Further, at the front side of the electron multiplier unit 100 (on the incidence side of photoelectrons from the photocathode 11) the conductive ring 3 is fixed through the insulators 40 and at the rear side of the electron multiplier unit 100 (on the emission side of secondary electrons from the final-stage dynode unit DY16) the anode 6 is fixed through the insulators 42. The insulators 43 are also provided on the opposite side to the insulators 42 through the anode 6.

Each of these members has the through holes extending along the direction L of incidence of light, as described above, and they are layered so that the through holes are aligned with each other in the lamination direction of the fine mesh dynodes. Each pipe 2 having one end processed in a T-shape is set through the space defined by these through holes along the lamination direction and a caulking 205 is formed in the portion exposed from the insulator 43, as shown in FIG. 5, thereby realizing the lamination structure of the electron multiplier unit 100. In other words, the pipes 2 determine positions of the above members in the lamination direction. FIG. 5 is an enlarged drawing of the portion represented by letter A in FIG. 4.

As shown in FIG. 5, the caulking 205 is formed by applying force in the direction normal to the lamination direction of fine mesh dynodes 50 to collapse the pipe 2, which realizes the assembly structure that can avoid application of unnecessary force in the lamination direction in assembling the electron multiplier unit 100. Each insulator 43 is comprised of two insulators 430 (upper part), 431 (lower part), and the diameter of a through hole in the insulator 431 is smaller than that of a through hole of the insulator 430.

Figure 6:
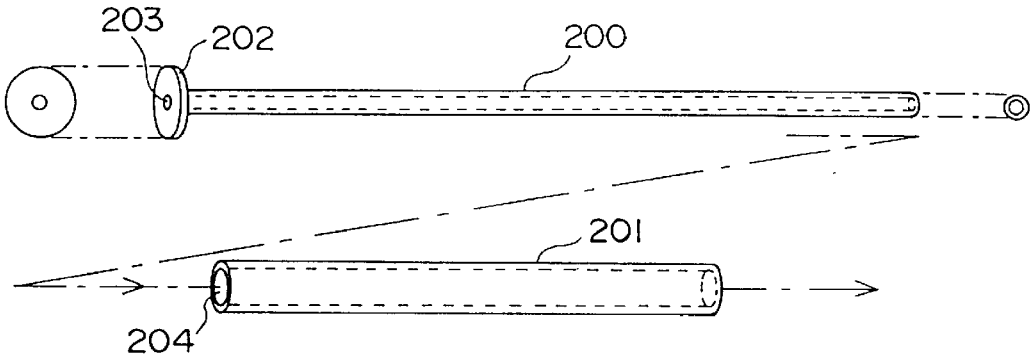
FIG. 6 and FIG. 7 are drawings to show the structure of the pipe used in forming the electron multiplier unit with the fine mesh dynodes layered at predetermined intervals.
Figure 7:
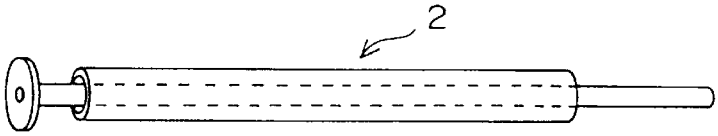

As shown in FIG. 6, each of the pipes 2 as described above consists of an inside pipe 200 made of a conductive material (stainless steel) and having an edge portion 202 processed at one end in a T-shape, and an outside pipe 201 made of an insulating material (alumina) and having a through hole 204 through which the inside pipe 200 is set. Of course, the diameter of a through hole 203 of the inside pipe 200 is smaller than the diameter of the through hole 204 of the outside pipe 201. And, the outside pipe 201 is shorter than the inside pipe 200 (see FIG. 7).

Figure 4:
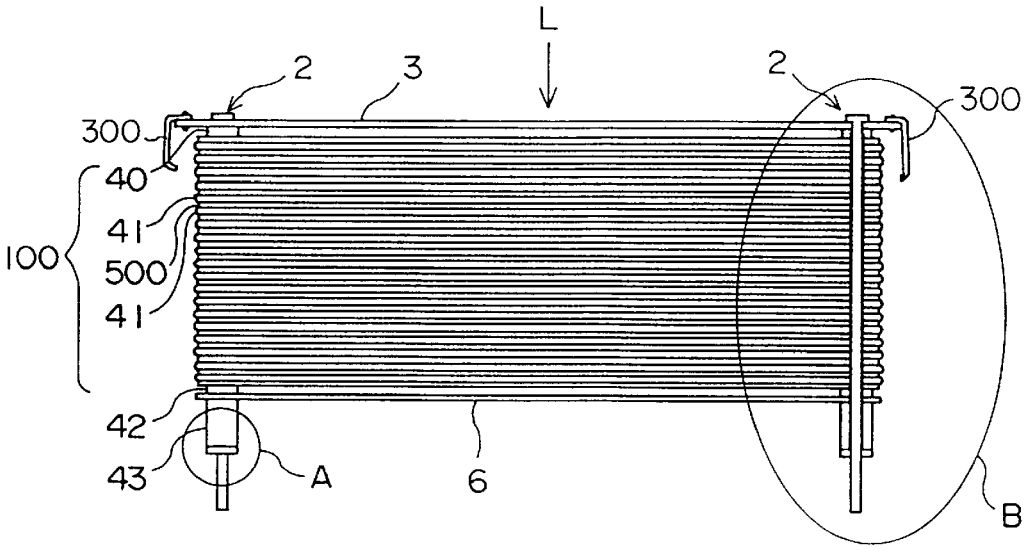
FIG. 4 is a drawing to show the structure of the electron multiplier unit in the photomultiplier shown in FIG. 2.
Figure 5:
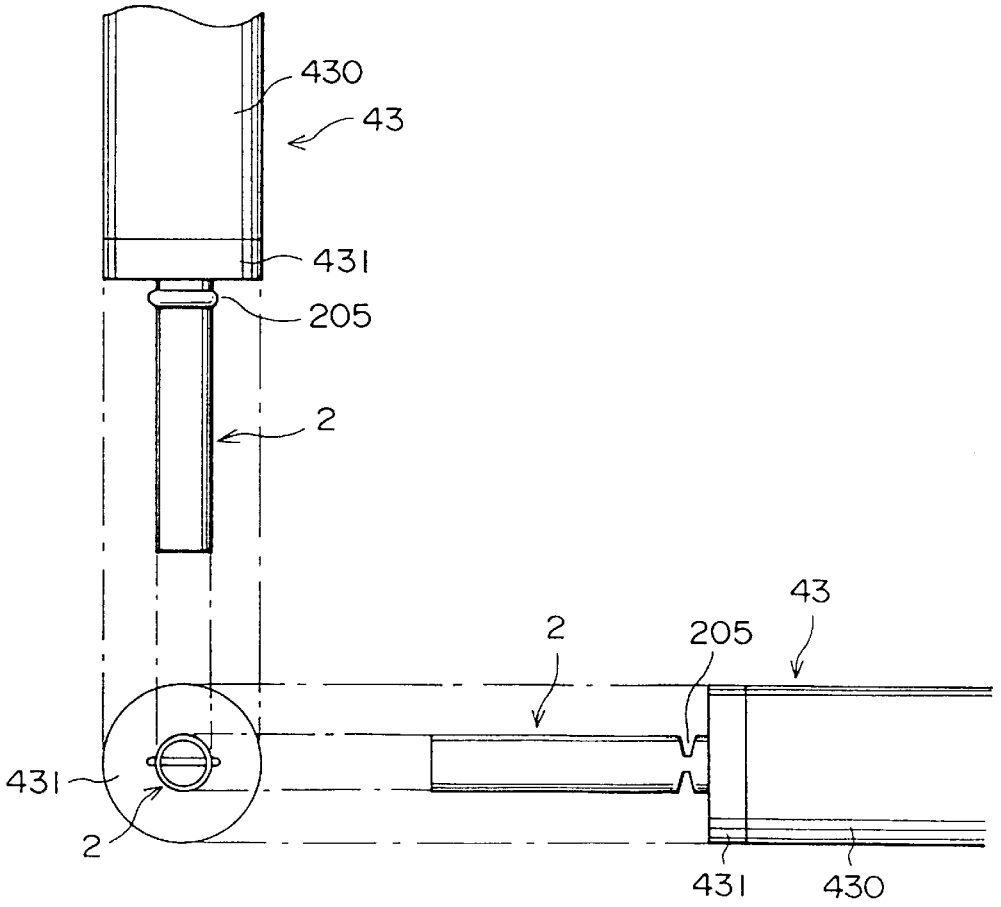
FIG. 5 is an enlarged drawing of the structure of the portion represented by A in FIG. 4.
Figure 8:
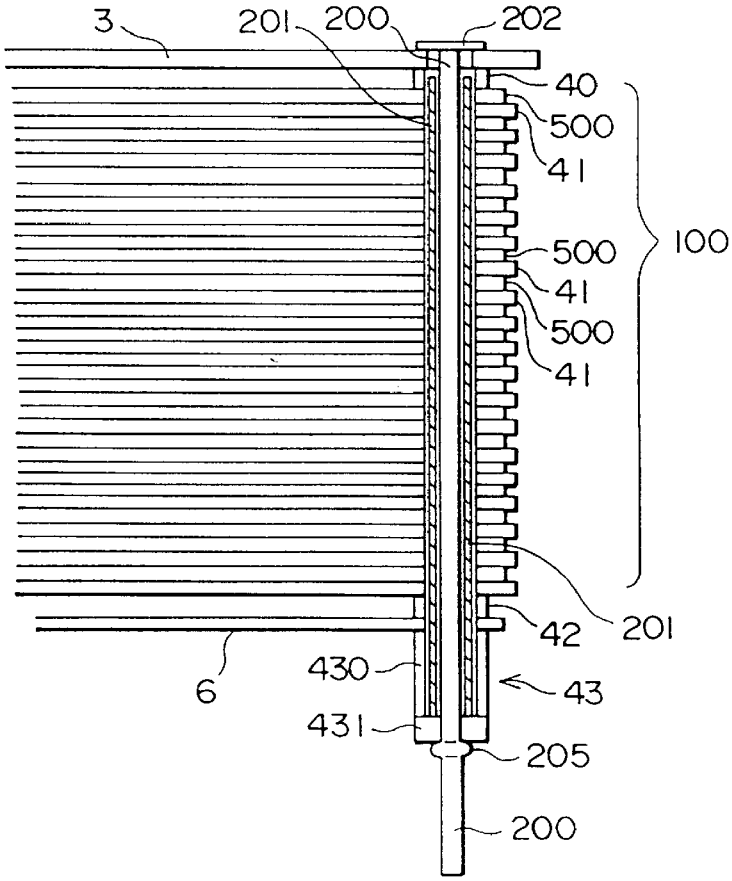
FIG. 8 is an enlarged drawing of the internal structure of the portion represented by B in FIG. 4.

FIG. 8 is an enlarged drawing of the portion represented by letter B in FIG. 4. As seen also from this figure, the outside pipe 201 is set in the space defined by the through holes of the above members (conductive ring 3, electron multiplier unit 100, anode 6, and insulators 40, 41, 42, 43). While penetrating the through hole 204 of the outside pipe 201, the inside pipe 200 penetrates the space as exposing its both ends. Accordingly, the positions of the above members in the lamination direction are determined by the T-shaped edge portions 202 and caulkings 205 of the inside pipes 200. The dynode units 500 are electrically insulated from the inside pipes 200 made of the conductive material by the outside pipes 201 made of the insulating material. Here, the insulator 431 as described above functions to keep the outside pipe 201 inside the aforementioned space. For this purpose, the diameter of the through hole of the insulator 431 is designed to be larger than the outer diameter of the inside pipe 200 and to be smaller than the inner diameter of the outside pipe 201.

As described above, the position of which each of the dynode units 500 should be defined in the lamination direction can be stably maintained by the T-shaped edge portion 202 and the caulking 205 of the inside pipe 200. For this structure, the fine mesh dynodes 50 can be prevent that they are ripped because of the deformation of the upper and lower electrodes 51, 52.

Figure 9:
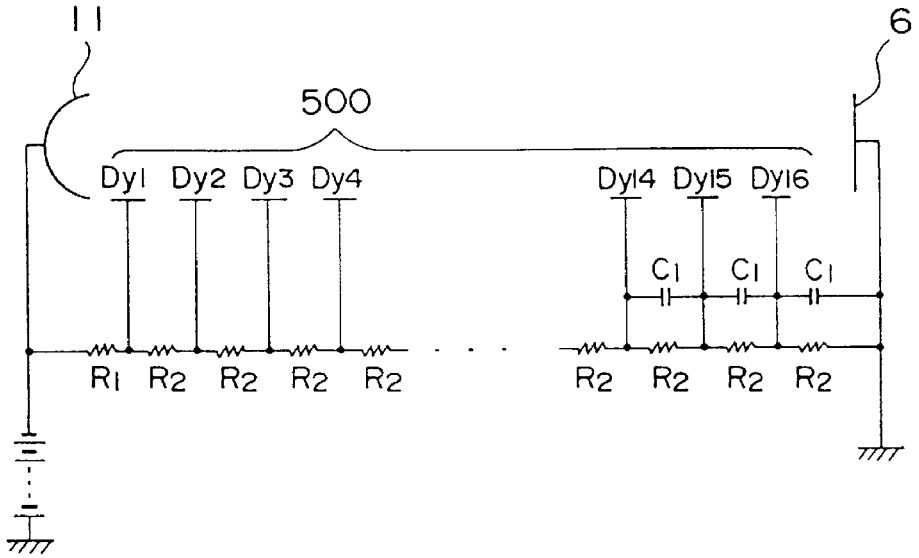
FIG. 9 is a drawing to show the structure of a bleeder circuit for setting the photocathode, the dynodes, and the anode at respective, predetermined potentials.

During operation of the photomultiplier the bleeder circuit shown in FIG. 9 applies predetermined voltages to the conductive ring 3, the fine mesh dynodes of the dynode units DY1–DY16, and the anode 6 to set them at respective, desired potentials. In more detail, voltages of several ten V to several hundred V are applied from the lead pins 9 held by the stem 8 through the relay lead pins 7 to between the conductive ring 3 and the first-stage dynode unit DY1 and to between the dynode unit $DY_k$ and the dynode unit $DY_{k+1}$ (k=1, 2, . . . , n−1, where n is a number of stages of the dynode units). At that time, the potential of the first-stage dynode unit DY1 is set higher than the potential of the conductive ring 3, the potential of the dynode unit $DY_{k+1}$ is set higher than the potential of the dynode unit $DY_k$, and the potential of the anode 6 is set higher than the potential of the final-stage dynode unit $DY_{16}$.

The photocathode 11 converts light incident to the light incidence portion 1*b* of the photomultiplier into photoelectrons. The photoelectrons generated in the photocathode 11 are focused as passing through an aperture 304 (see FIG. 10) of the conductive ring 3 and are accelerated toward the first-stage dynode unit DY1 by an electric field formed between the conductive ring 3 and the first-stage dynode unit DY1. When some of the photoelectrons thus accelerated come to collide with the fine mesh dynode 50 in the first-stage dynode unit DY1, the fine mesh dynode emits secondary electrons. Then the photoelectrons passing through the aperture of the first-stage fine mesh dynode and the secondary electrons thus emitted are accelerated toward the next dynode unit DY2 by the electric field applied, and further secondary electrons are emitted from the fine mesh dynode 50 in the second-stage dynode unit. As the photoelectrons and secondary electrons are guided in order from the first-stage dynode unit DY1 to the nth-stage dynode unit $DY_n$ in this manner, the secondary electrons are emitted as multiplied. The secondary electrons passing through the hole of the final-stage dynode unit DY16 are accelerated by the electric field between the final-stage dynode unit DY16 and the anode 6 to reach the anode 6. A quantity of light reaching the light incidence portion 1*b* of the photomultiplier can be measured based on a number of secondary electrons reaching the anode 6, that is, based on an amount of electric current flowing in the anode 6.

Figure 10:
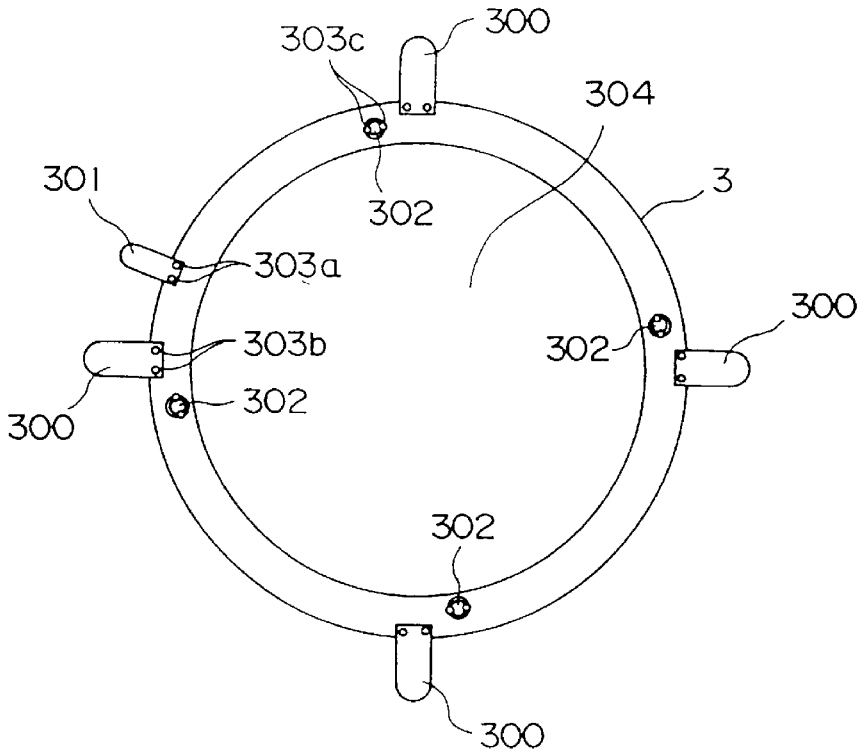
FIG. 10 is a plan view to show the detailed structure of the ring for setting the electron multiplier unit at the predetermined position in the closed container.
Figure 11:
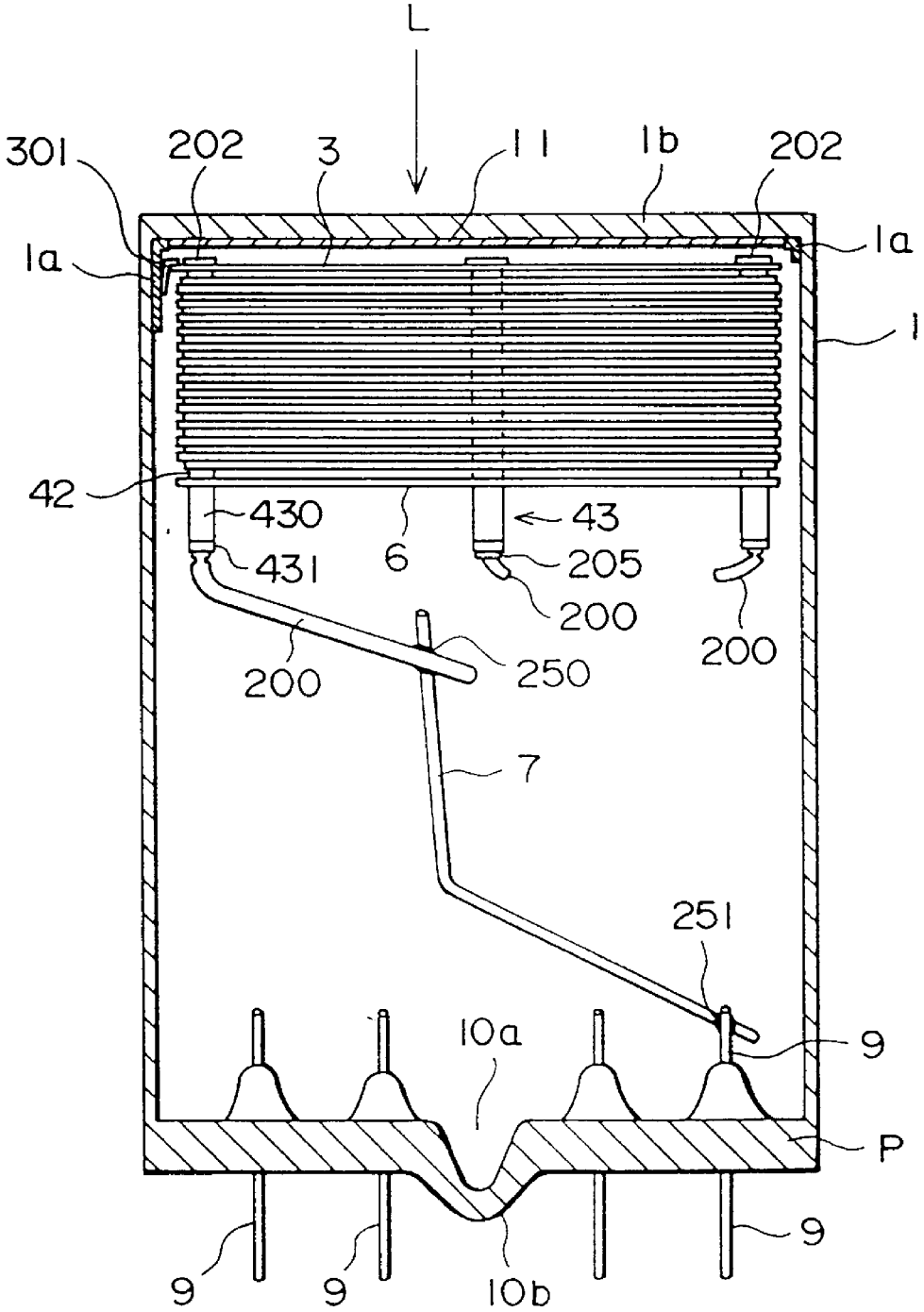
FIG. 11 is a cross-sectional view of the photomultiplier, for explaining the wiring structure for setting the photocathode at a predetermined potential.

The detailed structure of the conductive ring 3 is next explained referring to FIG. 10. This conductive ring 3 is disposed, as described above, between the photocathode 11 and the electron multiplier unit 100, and has an aperture 304 for letting photoelectrons emitted from the photocathode 11 pass. This conductive ring 3 has through holes 302 extending along the direction L of incidence of light, and a contact electrode 301 for setting the conductive ring 3 and photocathode 11 at a same potential. The edge portions 202 of inside pipes 200 are in direct contact with the conductive ring 3 when set through the through holes 302. This is for giving a predetermined potential to the photocathode 11 by electrically connecting the ends of the inside pipes 200 through the relay lead pins 7 with predetermined lead pins 9 in the stem 8, as shown in FIG. 11. Therefore, the inside pipes 200 function to define the lamination structure of the electron multiplier unit 100 and also function as lead pins for giving a predetermined potential to the photocathode 11. In FIG. 10, numeral 303*a* denotes weld portions for connecting the contact electrode 301 with the ring main body, and numeral 303*c* weld portions for reinforcing the through holes 302. In FIG. 11, numeral 250 designates a weld portion between the inside pipe 200 and the relay lead pin 7, and numeral 251 a weld portion between the relay lead pin 7 and the lead pin 9 penetrating the stem 8.

The conductive ring 3 is further provided with spring electrodes 300 for setting the electron multiplier unit 100 at a predetermined position in the closed container while spacing the electron multiplier unit 100 a predetermined distance apart from the internal wall of the closed container. Therefore, the spring electrodes 300 determine the position of the electron multiplier unit 100 in the closed container in the horizontal direction with respect to the direction L of incidence of light. In FIG. 10, numeral 303*b* denotes weld portions between the spring electrodes 300 and the ring main body.

Next explained referring to FIG. 12 to FIG. 16 is the structure of the fine mesh dynode adapted for the photomultiplier according to the present invention.

Figure 12:
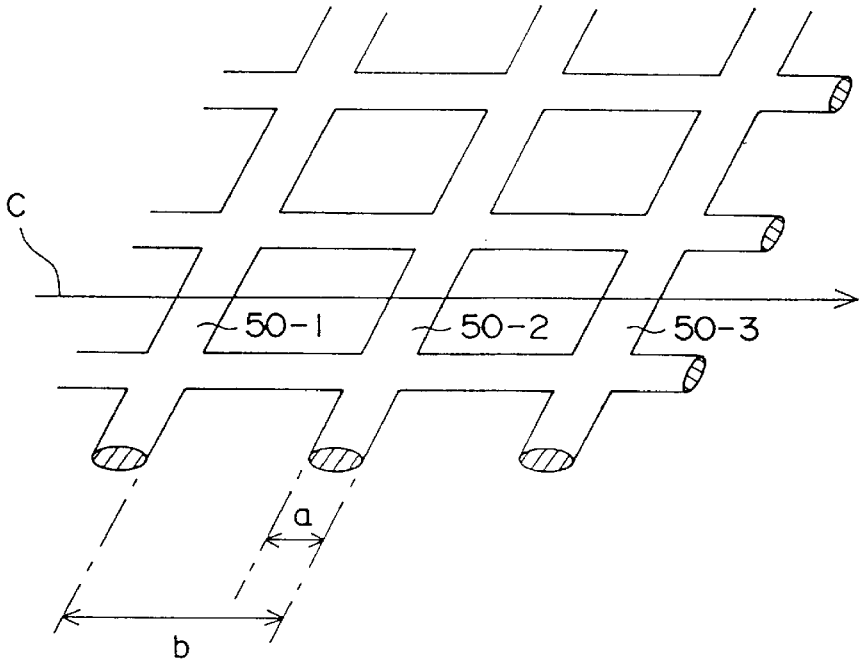
FIG. 12 is a perspective view to show the structure of a first embodiment of the fine mesh dynode.
Figure 13:
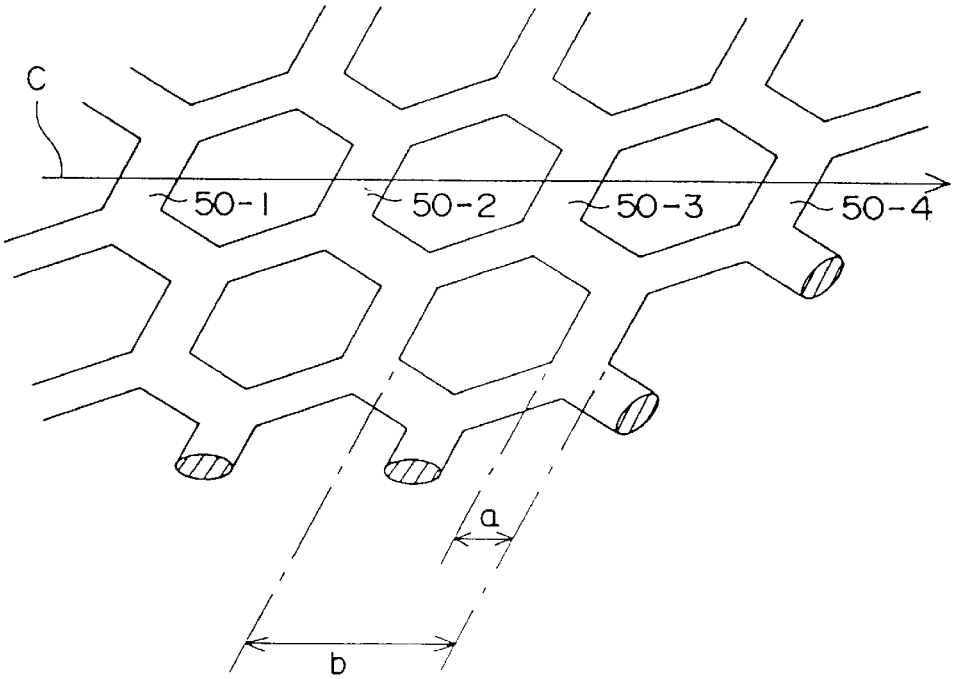
FIG. 13 is a perspective view to show the structure of a second embodiment of the fine mesh dynode.

Generally, the fine mesh dynode means a mesh dynode in which a number of lines 50-1, 50-2, 50-3, 50 -4, . . . existing on a reference line represented by the arrow C in FIG. 12 and FIG. 13 is 1000 or more per inch (=25.4 (mm)) of the reference line. A configuration of pores in the fine mesh dynode may be rectangular as shown in FIG. 12 or hexagonal as shown in FIG. 13.

This specification employs the porosity S (%) of fine mesh dynode. This porosity S following by the following equation when the line width is a and the line pitch is b.

$$S(\%)=[(b-a)^2/b^2]\times 100$$

Specifically, when the fine mesh dynode is of #1500, the line pitch b is 16.9 $\mu$m (=25.4 (mm)/1500 (lines)) and, for example, supposing the line width is 5.56 $\mu$m, the porosity is approximately 45%.

Figure 14:
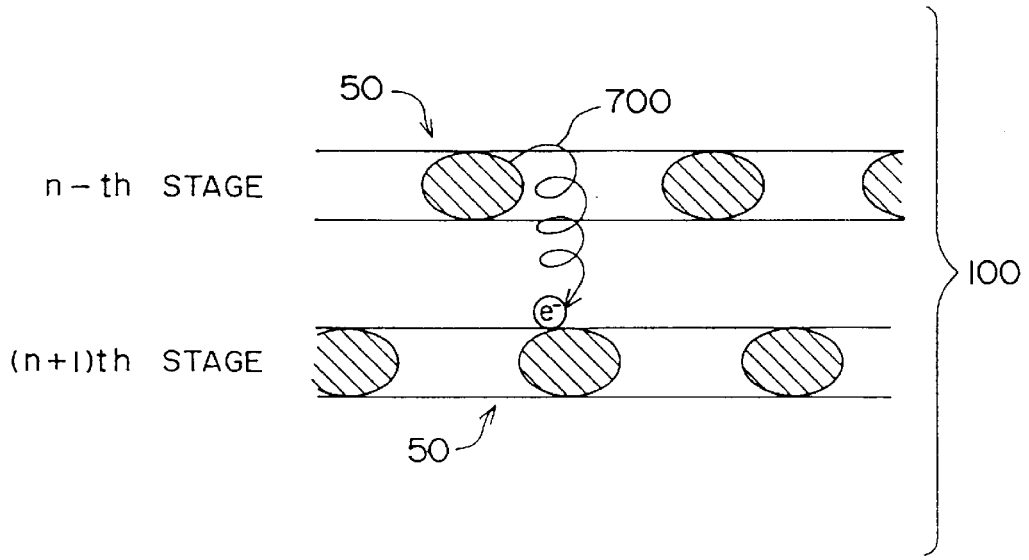
FIG. 14 and FIG. 15 are drawings for explaining a relationship between the behavior of an electron in a high magnetic field and the line width of fine mesh dynode shown in FIG. 12 and FIG. 13.
Figure 15:
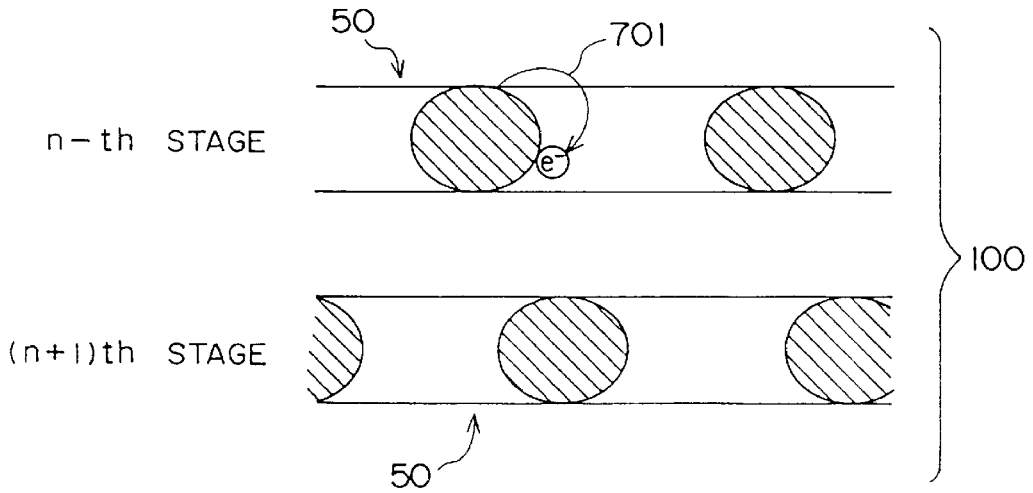

Next, the line width of fine mesh dynode is determined by behavior of electrons in the magnetic field. Namely, a secondary electron emitted from the fine mesh dynode in a high magnetic field traces an orbit 700 as rotating to reach the next fine mesh dynode, as shown in FIG. 14. However, if the line width of the fine mesh dynode is too large, the secondary electron emitted moves along an orbit 701 as shown in FIG. 15 so as to fail to reach the next fine mesh dynode. In other words, a too large line width decreases the multiplication factor (a number of secondary electrons reaching the anode/a number of photoelectrons occurring on the photoelectric surface) of the multiplier.

It is thus necessary to take account of the maximum radius of gyration of electron in the magnetic field in order to determine the line width of the fine mesh dynode. Specifically, the optimum line width was determined by the following calculation in this embodiment.

Namely, it is presumed that a peak of energy distribution of secondary electrons is approximately 2 (eV) to 3 (eV) (this embodiment employs an average value 2.5 (eV) for initial velocity $V_{101}$ of secondary electrons). The maximum radius of gyration R of electron is given when an angle of emission of electron is perpendicular to the magnetic field. Then, supposing magnetic flux density of magnetic field (B): 2 (T)
angle of emission of electron ($\theta$): 90°
initial velocity of electron ($V_\Phi$): 2.5 (eV)
velocity of electron (V): $(2\ eV_\Phi/m)^{(1/2)}$
mass of electron (m): $9.1095\times10^{-31}$
charge of electron (e): $1.6022\times10^{-19}$, the maximum radius of gyration R of electron is determined as follows.

$$\begin{aligned} R &= ((m\times V)/(e\times B))\times\sin\theta \\ &= 2.6659\times10^{-6}\ (\mathrm{m}) \\ &\approx 2.7\ (\mu\mathrm{m}) \end{aligned}$$

Figure 16:
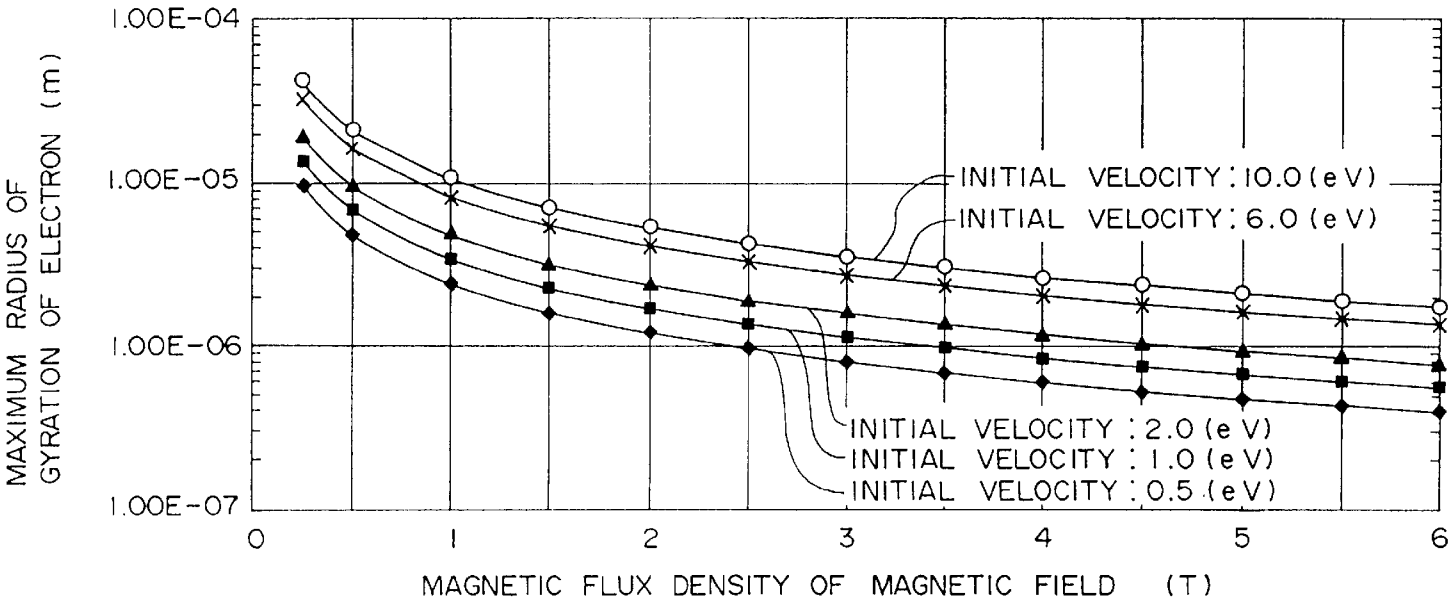
FIG. 16 is a graph to show a relationship (theoretical values) of maximum radius of gyration of electron versus strength of magnetic field.
Figure 17:
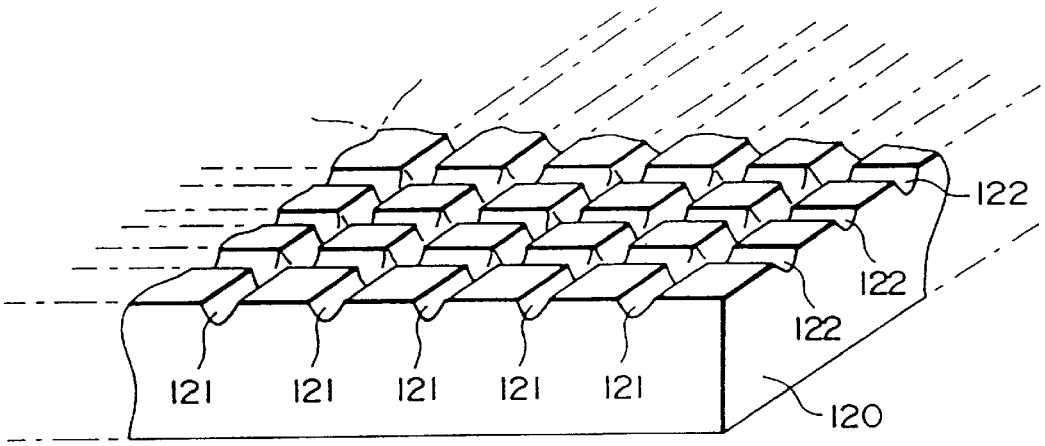
FIG. 17 and FIG. 18 are drawings to show production steps, for explaining a method for producing the fine mesh dynode.
Figure 18:
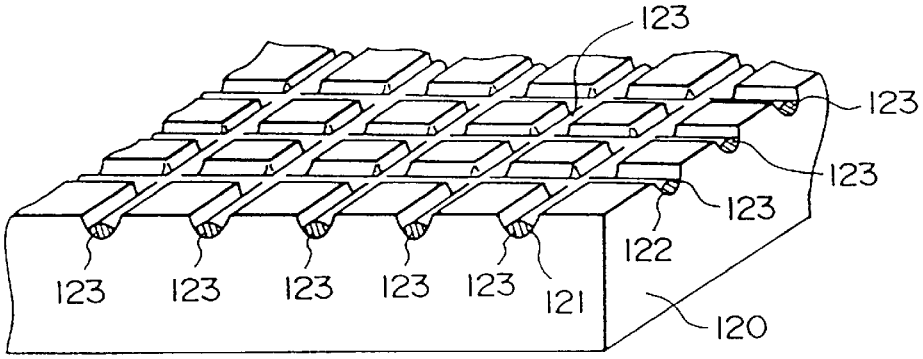

The maximum diameter of rotational motion of electron under the above conditions is thus approximately 5.4 ($\mu$m). For reference purpose, FIG. 16 shows calculation results of changes of the maximum radius of gyration against magnetic flux density (T) with electrons having different initial velocities.

As seen from the foregoing, the line width of fine mesh dynode needs to be set to be not more than 6 ($\mu$m). On the other hand, the line width needs to be set to be not less than 2.4 $\mu$m in order to give the fine mesh dynode strength enough to stand the tension applied during production thereof.

Next explained referring to FIG. 17 to FIG. 23 is a sequence of steps in a method for producing the fine mesh dynode as described above.

First, grooves 121, 122 are formed in a surface of glass plate 120 in a same pattern as the grid shape of the fine mesh dynode to be produced, and this is used as a master glass. Then the master glass plate 120 is washed with aqua regia and thereafter is dried (see FIG. 17).

Subsequently, a metal (for example, palladium, silver, platinum, or the like), which will become cores, is deposited on the surface of the master glass plate 120 by cathode sputtering. After that, leaving the metal 123 to become cores in the grooves 121, 122 in the surface of master glass plate 120, the excessive metal other than that is scraped off (see FIG. 18). Further, while a copper electrode is opposed to the master glass plate 120 having the cores 123 left in the grooves 121, 122, they are immersed in a copper plating bath and a voltage is applied between the two members to let an electric current flow. This effects plating of a copper film 124 on the cores 123 formed in the grooves 121, 122 in the surface of the master glass plate 120.

Figure 19:
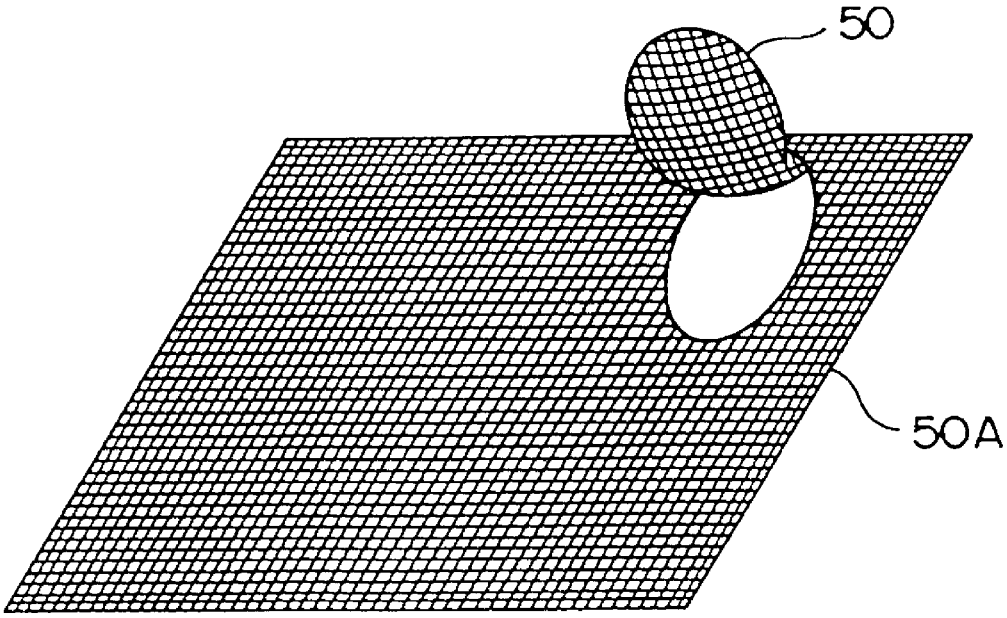
FIG. 19 is a view of a fine mesh sheet for producing the fine mesh dynode.
Figure 20:
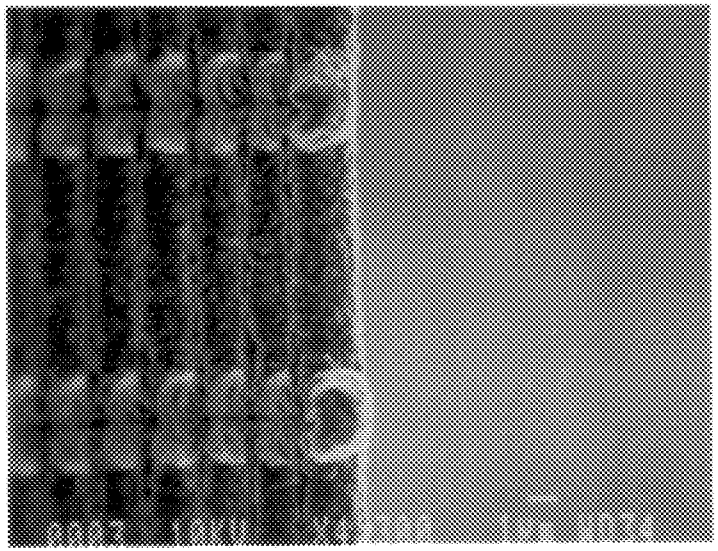
FIG. 20 and FIG. 21 are photographs to show edge portions of the fine mesh sheet of FIG. 19.
Figure 21:
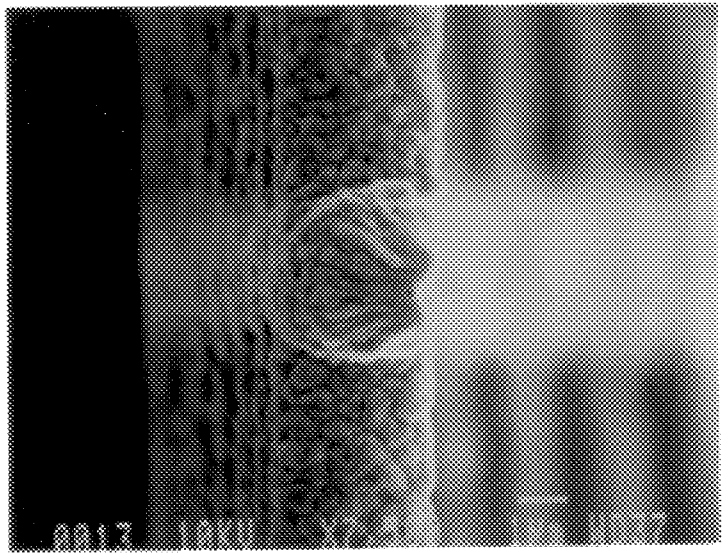

Next, the master glass plate 120 after the above steps is washed with water to strip the cores 123 with the plating layer of the copper film 124 off from the surface of the master glass plate 120, and then they are dried. This obtains a fine mesh sheet 50A formed on the surface of the master glass plate 120, as shown in FIG. 19. FIG. 20 and FIG. 21 are photographs to show edge portion of the mesh sheet 50A. In the photographs, wrinkles of the copper film 124 can be shown on the surface of the mesh 50A. However, the wrinkles will be removed by the following heating process.

The inventors carried out the above steps in sequence, thereby obtaining the fine mesh sheet 50A in which the configuration of the pores was nearly square and a cross-sectional configuration of the lines forming the grid pattern was nearly oval. With this fine mesh sheet 50A the line width was 5.5 μm, the line pitch 17 μm, and the porosity approximately 45%. The inventors further obtained the fine mesh dynodes of #1500, #2000, #2500 and #3000 with the porosity 45% and 50%, respectively. The following is line widths of the porosities 45% and 50% regarding the obtained fine mesh dynodes.

#1500: 5.6 μm (the porosity is 45%), 4.98 μm (the porosity is 50%);

#2000: 4.18 μm (the porosity is 45%), 3.72 μm (the porosity is 50%);

#2500: 3.34 μm (the porosity is 45%), 2.97 μm (the porosity is 50%); and

#3000: 2.79 μm (the porosity is 45%), 2.48 μm (the porosity is 50%).

Figure 22:
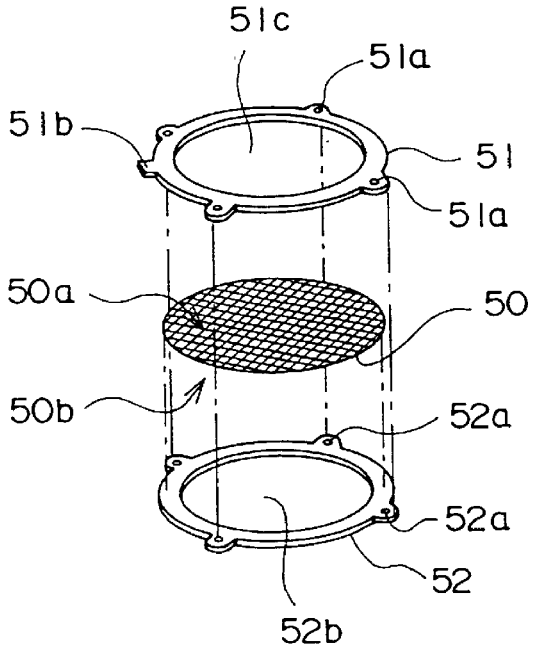
FIG. 22 and FIG. 23 are drawings to show production steps, for explaining a method for producing the dynode unit.

Next, a circular pattern is cut out of the fine mesh sheet 50A so constructed, to obtain a fine mesh dynode 50 (see FIG. 19). Since this fine mesh dynode 50 itself does not have sufficient strength, the fine mesh dynode 50 is sandwiched between the upper electrode 51 and lower electrode 52 on the both sides of the first surface 50*a* and second surface 50*b* of the fine mesh dynode 50, as shown in FIG. 22. In this step, the upper electrode 51 and lower electrode 52 are stacked so that through holes 51*a,* 52*a* thereof are aligned with each other. The upper electrode is provided with a projection 51*b* to which a relay lead pin 7 electrically connected with the lead pin 9 is welded in order to apply a predetermined voltage to the fine mesh dynode 50. Each of the upper and lower electrodes 51, 52 can be composed of metal such as nichrome, stainless SUS10S.

Figure 23:
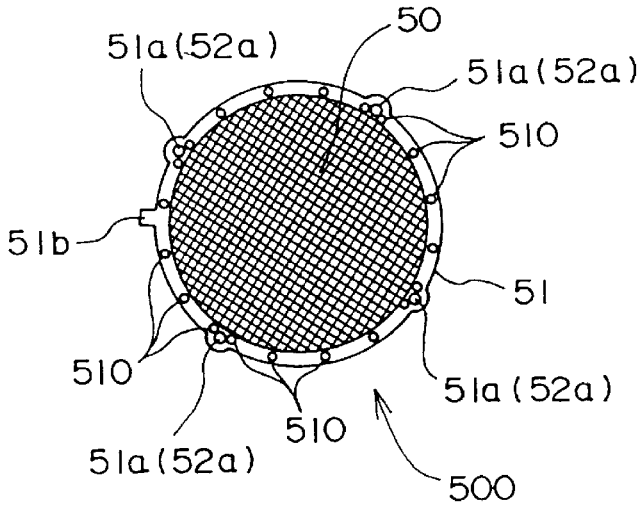

In order to even the tension on the fine mesh dynode 50 sandwiched, the upper electrode 51 and lower electrode 52 are welded at predetermined portions in a sandwich state of the fine mesh dynode 50, thereby producing a dynode unit 500 (see FIG. 23). In FIG. 23, numeral 510 denotes weld portions between the upper electrode 51 and the lower electrode 52.

However, all deflection of the fine mesh dynode 50 can not be eliminated even after the above steps. Then the dynode unit 500 obtained is set in an electric furnace in a vacuum state and is once heated to 600° C.–700° C. Thereafter, it is annealed to remove the deflection of the fine mesh dynode 50. A presumable reason why the deflection is removed is that an alloy is formed near the interface between the metal material (Pt) of cores and the plating material (Cu) and a volume change due to the alloy formation contributes to the elimination of deflection.

In the embodiment, in order to form a secondary electron emitting surface on the obtained fine mesh dynode 50, depositing of an aluminum (Al) film on the copper film 124, depositing of an antimony (Sb) film on the copper film 124 or depositing of an antimony film on the aluminum film formed on the copper film 124 is carried out. The reason why the above metal is deposited on the copper film 124 is to obtain a stable properties (drift) thereof. The deposition of the aluminum film and/or the antimony film is carried out at the photocathode side of the fine mesh dynode 50.

Figure 24:
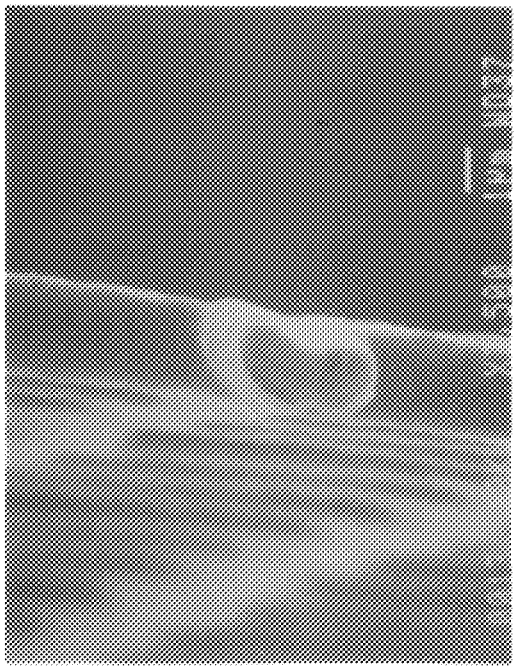
FIG. 24 is a photograph to show an edge portion of the fine mesh dynode obtained.
Figure 25:
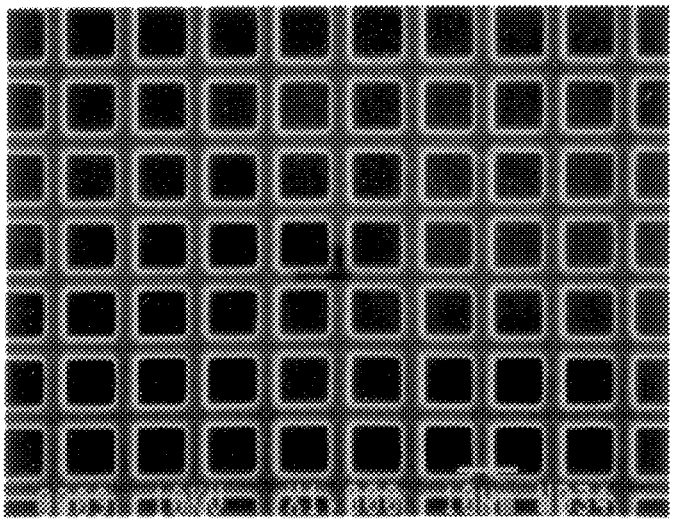
FIG. 25 and FIG. 26 are photographs to show the whole fine mesh dynode obtained.
Figure 26:
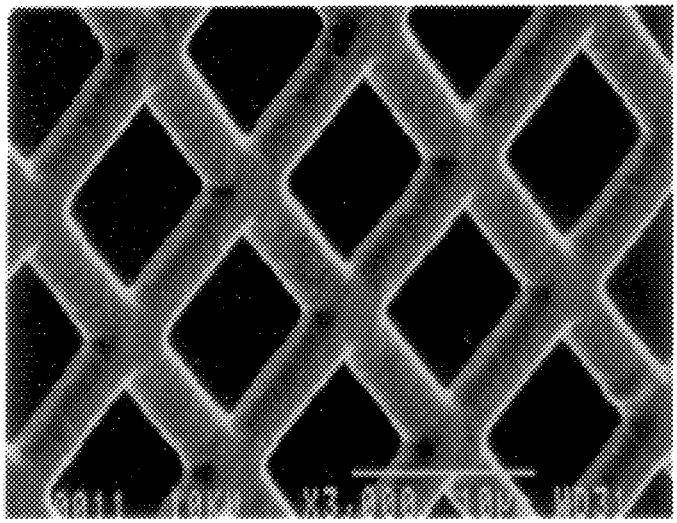

FIG. 24 is a photograph to show edge portions of the fine mesh dynode 50 having an aluminum film thereon after heating process. Furthermore, FIG. 25 is a photograph to show the whole fine mesh dynode 50 after heating process, and a photograph of FIG. 26 shows a view of the fine mesh dynode 50 of FIG. 25 at the angle of 45 degrees.

Next described are results of experiments and simulation calculations of multiplication factor of photomultiplier against porosity of the fine mesh dynode 50 as to each of the number of stages, the distance between stages, and the strength of magnetic field with the fine mesh dynode 50 produced as described above.

Figure 27:
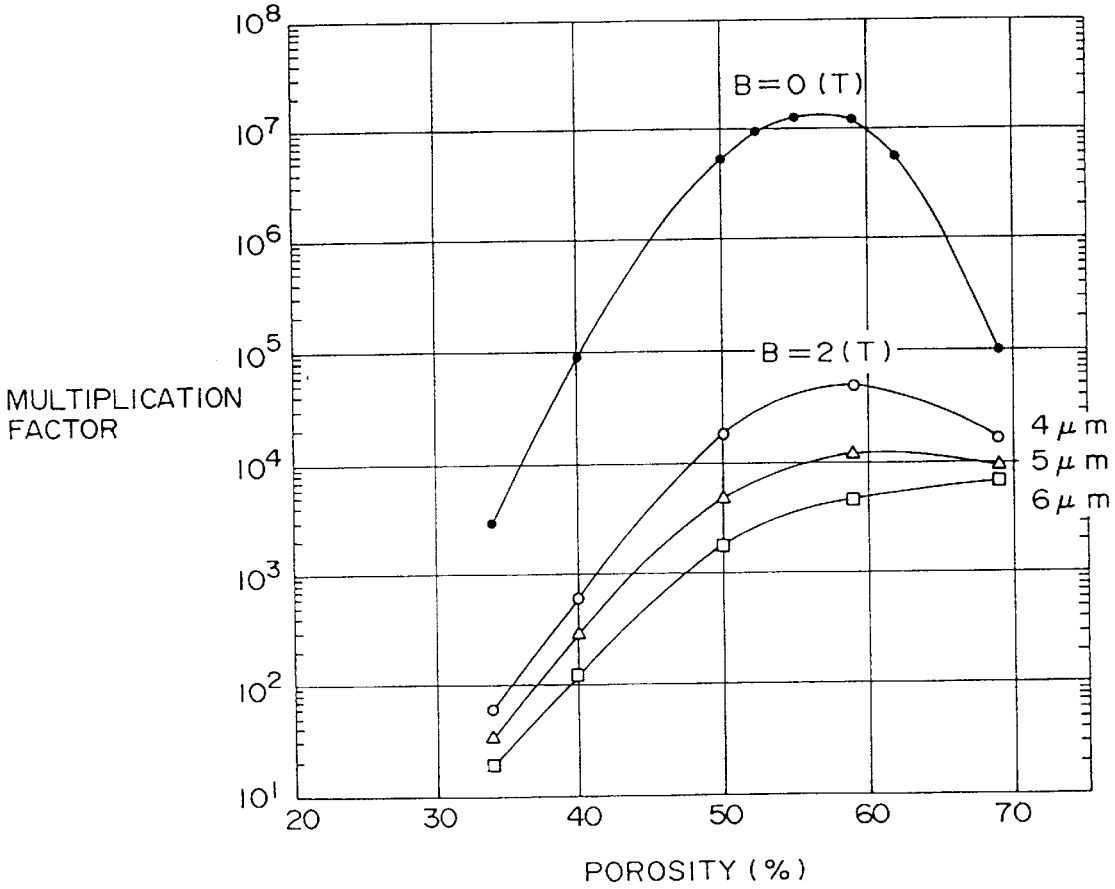
FIG. 27 is a graph to show a relationship of multiplication factor of the photomultiplier according to the present invention versus porosity of fine mesh dynode, in which theoretical values and measured values of multiplication factor for each line width are shown for each of samples having different porosities with a constant line width and a variety of line pitches.

FIG. 27 is a graph to show a relationship of multiplication factor of the photomultiplier according to the present invention against porosity of fine mesh dynode 50. This graph shows theoretical values and measured values of multiplication factor for each line width with samples having different porosities as keeping the line width constant but changing the line pitch (the line width is selected from 4 μm, 5 μm, and 6 μm). Without application of the magnetic field (B=0 (T)), the multiplication factor is not less than $1\times10^{-7}$ in the range of porosity 53% to 60%, which is 100 or more times greater than the multiplication factor $1\times10^{5}$ near the porosity 40%.

When the magnetic flux density of magnetic field is 2 T, the fine mesh dynodes of the line width of 4 μm showed the multiplication factors in the range of porosity 55 to 62% 100 or more times greater than those near the porosity 40%. The fine mesh dynodes of 5 μm showed the multiplication factors near the porosity 60% approximately 100 times greater than those near the porosity 40%. The fine mesh dynodes of 6 μm showed the multiplication factors in the range of porosity 62 to 70% 100 or more times greater than those near the porosity 40%.

Figure 28:
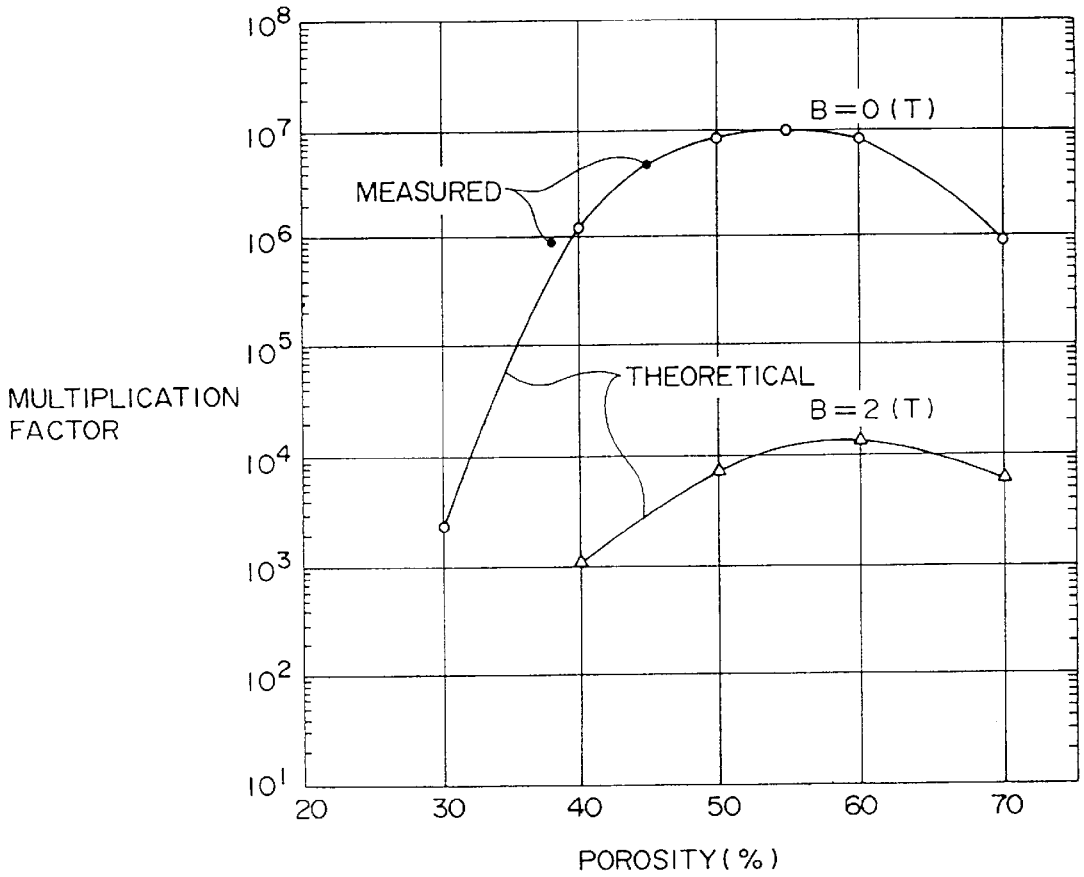
FIG. 28 is a graph to show a relationship of multiplication factor of the photomultiplier according to the present invention versus porosity of fine mesh dynode, in which theoretical values and measured values of multiplication factor with changes of magnetic flux density in the magnetic field are shown for each of samples having different porosities with a constant line pitch and a variety of line widths.

FIG. 28 is a graph to show a relation of multiplication factor of the photomultiplier according to the present invention against porosity of fine mesh dynode. This graph shows theoretical values and measured values of multiplication factor for different magnetic flux densities in the magnetic field (B=0 (T) and 2 (T)) with samples having different porosities as keeping the line pitch constant but changing the line width.

According to the simulation calculations, without application of the magnetic field (B=0 (T)), the multiplication factors near the porosity 55% are approximately 100 times greater than those near the porosity 35% and results of experiments and results of simulation calculations show similar tendency as obtaining the same multiplication factor at the porosity 45%. When the magnetic flux density of the magnetic field is 2 T, the multiplication factors near the porosity 60% are approximately 10 times greater than those near the porosity 40%.

Figure 29:
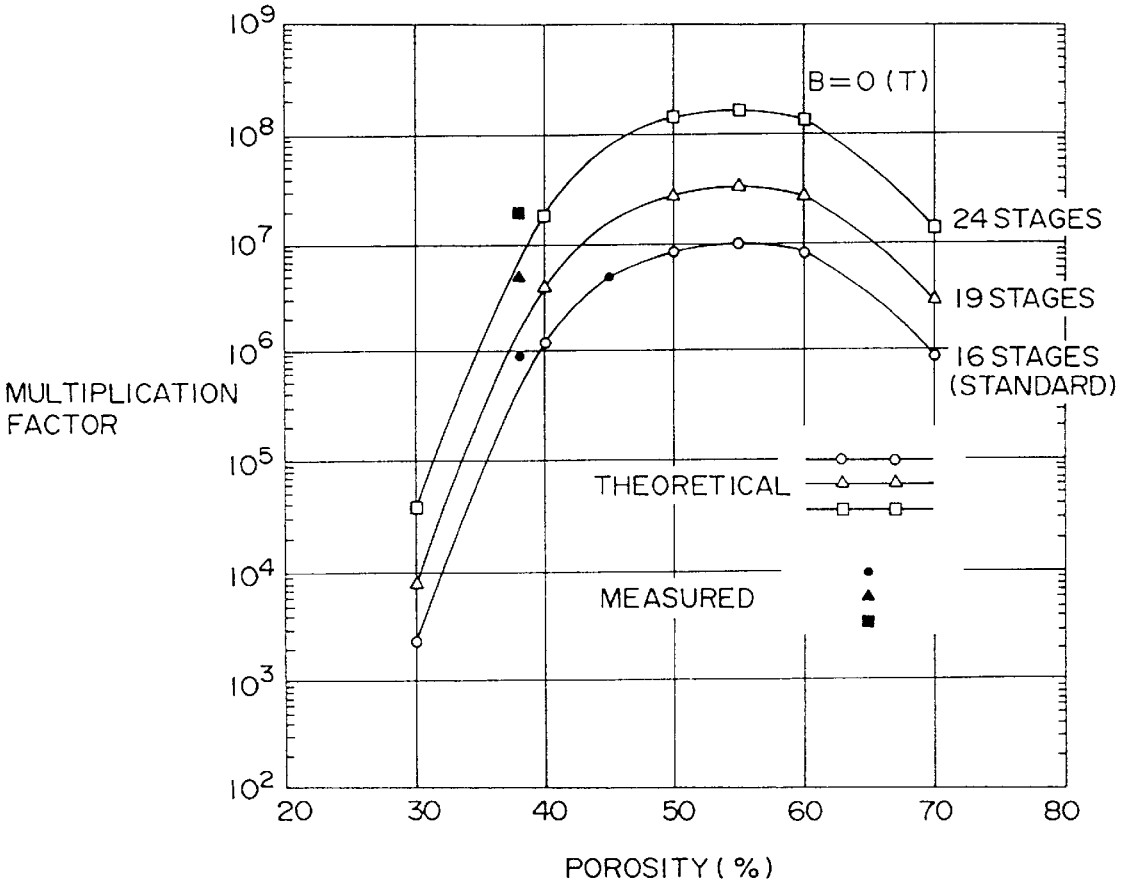
FIG. 29 is a graph to show a relationship of multiplication factor of the photomultiplier according to the present invention versus porosity of fine mesh dynode, in which theoretical values and measured values of multiplication factor with changes of the number of stages (the number of dynode stages) of the electron multiplier unit are shown for each of samples having different porosities with a constant line pitch and a variety of line widths.

FIG. 29 is a graph to show a relation of multiplication factor of the photomultiplier according to the present invention against porosity of fine mesh dynode. This graph shows theoretical values and measured values of multiplication factor for different numbers of stages in the electron multiplier unit (different numbers of stages of dynodes) (in the cases of sixteen stages, nineteen stages, and twenty four stages) with samples having different porosities as keeping the line pitch constant but changing the line width.

According to the simulation calculations, in either case, the maximum multiplication factor was obtained near the porosity 55%, and was approximately 100 times greater than those near the porosity 35%. Further, the results of experiments and the results of simulation calculations showed similar tendency as obtaining the same multiplication factor at the porosity 45%.

From the above results of experiments, the inventors reached the conclusion that the porosity of fine mesh dynode should be set in the range of 45% to 65% in order to obtain a preferred multiplication factor of the photomultiplier. However, because the fine mesh dynode 50 is formed as described above, the fine mesh dynode 50 is demanded to have appropriate strength. From this standpoint, the porosity of the fine mesh dynode 50 is most preferably set in the range of 45% to 50%.

Further, the inventors obtained simulation results (theoretical values) and measured values of multiplication factor of the photomultiplier for fine mesh dynodes having different porosities as keeping the line pitch constant but changing the line width, where the intervals between the adjacent fine mesh dynodes are either one of 0.4 mm, 0.8 mm, and 1.6 mm. In this case the maximum multiplication factor was also obtained in the range of the porosity 45 to 65% similarly.

Similar effects were achieved between in the case where the positions of pores are aligned among the stages of fine mesh dynodes and in the case where they were arranged at random.

From the all results of the above various experiments and simulation calculations, the multiplication factor of photomultiplier becomes maximum when the porosity of fine mesh dynode is in the range of 45% to 60% in each of the cases of the number of stages of fine mesh dynodes, the intervals between the dynodes, and the strength of magnetic field. From the viewpoint of production, it was found that the porosity of fine mesh dynode was preferably set particularly in the range of 45% to 50%.

The present invention is by no means limited to the embodiments as described above, but may have various modifications. For example, the configuration of the pores of fine mesh dynode may be rectangular, hexagonal, or polygonal other than the foregoing. Specifically, the fine mesh dynode may have the configuration of hexagonal pores, for example, as shown in FIG. 13. This fine mesh dynode is of a configuration in which hexagonal pores are arranged in a honeycomb shape. Further, an irregular shape may be applied to the configuration of pores in the fine mesh dynode, or pores in different shapes may be arranged.

As detailed above, the present invention realized the lamination structure of electron multiplier unit defined by the hollow pipes penetrating the electrodes supporting the fine mesh dynodes. This achieves the photomultiplier having accurately controlled intervals between the fine mesh dynodes and well controlled in production errors. Since a part of the hollow pipe is made of a conductive material, it can function as a part of the supply structure of voltage applied in order to set the photocathode at a predetermined potential.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 121492/1995 filed on May 19, 1995 is hereby incorporated by reference.

What is claimed is:

1. A photomultiplier comprising:

a photocathode for emitting photoelectrons according to light incident thereto;

an electron multiplier unit for cascade-multiplying the photoelectrons emitted from said photocathode, said electron multiplier unit being formed by laminating a plurality of dynode units spaced at predetermined intervals from each other through an insulator having a through hole extending along a direction of incidence of said light, wherein each dynode unit comprises a fine mesh dynode having at least 1000 or more lines per inch, an upper electrode having an aperture portion for exposing said fine mesh dynode and a through hole extending along the direction of incidence of said light, and a lower electrode having an aperture portion for exposing said fine mesh dynode and a through hole extending along the direction of incidence of said light and holding an edge portion of said fine mesh dynode in a sandwich structure in cooperation with said upper electrode;

an anode for collecting secondary electrons emitted from said electron multiplier unit, said anode having a through hole extending along the direction of incidence of said light; and a pipe penetrating a space defined by at least the through hole of said insulator, the through holes of said dynode units, and the through hole of said anode along the direction of incidence of said light, said pipe comprising an outside pipe made of an insulating material and an inside pipe made of a conductive material and penetrating said outside pipe.

2. A photomultiplier according to claim 1, wherein an interval between said photocathode and the dynode unit directly opposed to said photocathode out of said dynode units is between 2.0 mm and 5.0 mm and an interval between fine mesh dynodes of such adjacent dynode units is between 0.4 mm and 1.6 mm.

3. A photomultiplier according to claim 1, wherein the length of said inside pipe is longer than that of said outside pipe.

4. A photomultiplier according to claim 1, wherein said outside pipe has at least a length enough for the whole of said outside pipe to be set inside said space defined by the through hole of said insulator, the through holes of said dynode units, and the through hole of said anode, and wherein said inside pipe has at least a length enough to penetrate said space defined by the through hole of said insulator, the through holes of said dynode units, and the through hole of said anode and to expose both ends thereof from said space.

5. A photomultiplier according to claim 1, wherein said inside pipe has an edge portion of a diameter larger than a diameter of an aperture of said outside pipe, at a first end thereof.

6. A photomultiplier according to claim 1, wherein a number of lines constituting said fine mesh dynode is 1500 or more per inch and a width of the lines is between 2.4 $\mu$m and 6 $\mu$m.

7. A photomultiplier according to claim 1, wherein said fine mesh dynode has a width of lines between 2.4 $\mu$m and 6 $\mu$m and a porosity between 45% and 65%.

8. A photomultiplier according to claim 7, wherein said fine mesh dynode has a width of lines between 2.4 $\mu$m and 6 $\mu$m and a porosity between 45% and 50%.

9. A photomultiplier according to claim 1, further comprising a conductive ring disposed between said photocathode and the electron multiplier unit and having an aperture for letting the photoelectrons emitted from the photocathode pass, wherein said conductive ring has a through hole extending along the direction of incidence of said light and a contact electrode for setting said conductive ring and said photocathode at a same potential, and wherein said conductive ring is in direct contact with said edge portion of the inside pipe when said inside pipe is set at least through the through hole of said conductive ring.

10. A photomultiplier according to claim 9, wherein said insulator comprises:

an upper insulator for defining an interval between said conductive ring and said electron multiplier unit and having a through hole extending along the direction of incidence of said light and penetrated by said pipe, and a lower insulator in contact with a surface of said anode opposite to a surface opposed to said electron multiplier unit, for separating said anode a predetermined distance apart from a second end of said pipe located on an opposite side to said first end.

11. A photomultiplier comprising:

a closed container made of a conductive material and having lead pins guided from the outside into the inside;

a photocathode, provided in an internal wall of said closed container, for emitting photoelectrons according to light incident from the outside of said closed container;

an electron multiplier unit for cascade-multiplying the photoelectrons emitted from said photocathode, said electron multiplier unit being formed by laminating a plurality of dynode units spaced at predetermined intervals from each other through a first insulator having a through hole extending along a direction of incidence of said light, wherein each dynode unit comprises a fine mesh dynode having at least 1000 or more lines per inch, an upper electrode having an aperture portion for exposing said fine mesh dynode and a through hole extending along the direction of incidence of said light, and a lower electrode having an aperture portion for exposing said fine mesh dynode and a through hole extending along the direction of incidence of said light and holding an edge portion of said fine mesh dynode in a sandwich structure in cooperation with said upper electrode;

an anode for collecting secondary electrons emitted from said electron multiplier unit, said anode having a through hole extending along the direction of incidence of said light;

a conductive ring disposed between said photocathode and said electron multiplier unit and having an aperture for letting the photoelectrons emitted from the photocathode pass, said conductive ring comprising a through hole extending along the direction of incidence of said light and a contact electrode for setting said conductive ring and said photocathode at a same potential; and a pipe penetrating a space defined by at least the through hole of said conductive ring, the through hole of said first insulator, the through holes of said dynode units, and the through hole of said anode along the direction of incidence of said light, said pipe comprising an outside pipe made of an insulating material and an inside pipe made of a conductive material and penetrating said outside pipe so that a first end thereof is electrically connected with associated one of said lead pins and a second end thereof is in direct contact with said conductive ring.

12. A photomultiplier according to claim 11, wherein said conductive ring is fixed to said electron multiplier unit by said pipe penetrating the through hole of said conductive ring in a state where said conductive ring is spaced a predetermined distance apart from said electron multiplier unit through a second insulator, said second insulator has a through hole extending along the direction of incidence of said light, and said pipe is set through said through hole.

13. A photomultiplier according to claim 11, wherein the length of said inside pipe is longer than that of said outside pipe.

14. A photomultiplier according to claim 12, wherein said conductive ring comprises a spring electrode for setting said electron multiplier unit at a predetermined position in said closed container in a state where said electron multiplier unit is spaced a predetermined distance apart from an internal wall of said closed container.

15. A photomultiplier according to claim 11, wherein an interval between said photocathode and the dynode unit directly opposed to said photocathode out of said dynode units is between 2.0 mm and 5.0 mm and an interval between fine mesh dynodes of such adjacent dynode units is between 0.4 mm and 1.6 mm.

16. A photomultiplier according to claim 11, wherein said inside pipe has an edge portion of a diameter larger than a diameter of an aperture of said outside pipe, at the first end thereof.

17. A photomultiplier according to claim 11, wherein a number of lines constituting said fine mesh dynode is 1500 or more per inch and a width of the lines is between 2.4 $\mu$m and 6 $\mu$m.

18. A photomultiplier according to claim 11, wherein said fine mesh dynode has a width of lines between 2.4 $\mu$m and 6 $\mu$m and a porosity between 45% and 65%.

19. A photomultiplier according to claim 18, wherein said fine mesh dynode has a width of lines between 2.4 $\mu$m and 6 $\mu$m and a porosity between 45% and 50%.

20. A photomultiplier according to claim 12, further comprising a third insulator in contact with a surface of said anode opposite to a surface thereof opposed to said electron multiplier unit, for spacing said anode a predetermined distance apart from the second end of said pipe located opposite to said first end.

21. A photomultiplier according to claim 20, wherein said outside pipe has at least a length enough for the whole of said outside pipe to be set inside said space defined by the through hole of said conductive ring, the through holes of said first to third insulators, the through holes of said dynode units, and the through hole of said anode, and wherein said inside pipe has at least a length enough to penetrate said space defined by the through hole of said conductive ring, the through holes of said first to third insulators, the through holes of said dynode units, and the through hole of said anode and to expose both ends thereof from said space.

* * * * *